US010920526B2

(12) United States Patent
Abeidoh et al.

(10) Patent No.: US 10,920,526 B2
(45) Date of Patent: Feb. 16, 2021

(54) DOWNHOLE INTERVENTIONLESS TOOLS, SYSTEMS, AND METHODS FOR SETTING PACKERS

(71) Applicant: Halliburton Energy Services, Inc., Houston, TX (US)

(72) Inventors: Abdel Hamid Rawhi Abeidoh, Dallas, TX (US); Colby Munro Ross, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 29 days.

(21) Appl. No.: 16/341,342

(22) PCT Filed: Jun. 7, 2017

(86) PCT No.: PCT/US2017/036269
§ 371 (c)(1),
(2) Date: Apr. 11, 2019

(87) PCT Pub. No.: WO2018/226216
PCT Pub. Date: Dec. 13, 2018

(65) Prior Publication Data

US 2019/0264536 A1 Aug. 29, 2019

(51) Int. Cl.
*E21B 34/10* (2006.01)
*E21B 33/12* (2006.01)
(Continued)

(52) U.S. Cl.
CPC ..... *E21B 34/10* (2013.01); *E21B 23/04* (2013.01); *E21B 23/06* (2013.01); *E21B 33/128* (2013.01);
(Continued)

(58) Field of Classification Search
CPC ..... E21B 34/10; E21B 33/12; E21B 23/06; E21B 2200/06
See application file for complete search history.

(56) References Cited

U.S. PATENT DOCUMENTS 4,237,979 A 12/1980 Weise
4,493,374 A 1/1985 Magee, Jr.
(Continued)

FOREIGN PATENT DOCUMENTS

RU 2452848 C2 6/2012
RU 2499124 C1 11/2013
(Continued)

OTHER PUBLICATIONS

International Search Report and Written Opinion of PCT Application No. PCT/US2017/036269 dated Mar. 5, 2018: pp. 1-17.

*Primary Examiner* — Catherine Loikith
(74) *Attorney, Agent, or Firm* — Chamberlain Hrdlicka

(57) ABSTRACT

Hydraulic setting tools, packer setting systems, and methods thereof are provided. The hydraulic setting tool includes a mandrel containing a main flow path, a piston housing surrounding at least a portion of the mandrel, and a piston disposed between the piston housing and the mandrel. A cavity is defined at least partially between the piston, the piston housing, and the mandrel. The tool also includes a port passing through the mandrel and configured to provide fluid communication between the main flow path and of the cavity, and an isolation sleeve located within the mandrel and movable along the main flow path between a closed position and an opened position to control the fluid communication between the main flow path and the cavity via the port. A remotely activated valve is located downstream from the isolation sleeve along the main flow path and controls the fluid passing therethrough.

19 Claims, 4 Drawing Sheets

(51) Int. Cl.

| | |
|---|---|
| ***E21B 23/06*** | (2006.01) |
| ***E21B 33/128*** | (2006.01) |
| ***E21B 34/06*** | (2006.01) |
| ***E21B 23/04*** | (2006.01) |
| *E21B 47/117* | (2012.01) |

(52) U.S. Cl.
CPC ..... *E21B 34/063* (2013.01); *E21B 47/117* (2020.05); *E21B 2200/06* (2020.05)

(56) References Cited

U.S. PATENT DOCUMENTS

| | | | | |
|---|---|---|---|---|
| 4,773,478 | A | 9/1988 | Streich | |
| 4,823,881 | A | 4/1989 | Streich | |
| 5,240,077 | A | 8/1993 | Whitsitt | |
| 5,505,263 | A | 4/1996 | White et al. | |
| 6,997,252 | B2 | 2/2006 | Porter et al. | |
| 7,077,212 | B2 * | 7/2006 | Roesner ..... | E21B 23/06 166/120 |
| 8,616,276 | B2 * | 12/2013 | Tips ..... | E21B 41/00 166/250.15 |
| 8,936,101 | B2 | 1/2015 | McGlothen et al. | |
| 2008/0230235 | A1 | 9/2008 | Loughlin | |
| 2013/0284426 | A1 | 10/2013 | Watson | |
| 2017/0081938 | A1 | 3/2017 | Richards et al. | |

FOREIGN PATENT DOCUMENTS

| | | |
|---|---|---|
| RU | 2521238 C2 | 6/2014 |
| WO | 2007092082 | 8/2007 |

* cited by examiner

DOWNHOLE INTERVENTIONLESS TOOLS, SYSTEMS, AND METHODS FOR SETTING PACKERS

BACKGROUND

This section is intended to provide relevant background information to facilitate a better understanding of the various aspects of the described embodiments. Accordingly, it should be understood that these statements are to be read in this light and not as admissions of prior art.

In the course of treating and preparing a subterranean well for production, packers are commonly placed into the wellbore on a conveyance such as a work string or production tubing. Certain production packers are set hydraulically, requiring that a pressure differential be created across a setting piston. Some packer setting tools require the use of a ball to be dropped in order to shift open an isolation sleeve to be able to set the packer after testing lower seals. Typically, circulation and injection is also required in order to ensure that the ball lands on the seat of the isolation sleeve, which is not always feasible, such as in cased hole designs. If the ball-drop method is not possible, the isolation sleeve is omitted and packer setting pins are used to control packer setting. The packer setting pins are set to shear at a greater pressure value than the test pressure in order to not set the packer during the test. As a result, the test pressure must be less than the packer setting pressure. Therefore, the lower testing pressure does not validate that the seals will hold at the greater pressure used during the packer setting. Furthermore, packer setting pressures may not be feasible at the intended testing pressure.

Therefore, there is a need for a packer setting tool that eliminates the requirement for a ball drop, is isolated from hydraulic pressure during testing or circulating operations, does not require circulation or injection capability, can allow for significantly greater test pressures than typical packer setting pressures, and can be remotely activated to disable the isolation from the hydraulic pressure.

BRIEF DESCRIPTION OF THE DRAWINGS

Embodiments of the invention are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Interventionless packer setting and testing systems, hydraulic setting tools, and methods thereof for downhole deployment are provided in embodiments described herein.

Figure 1:
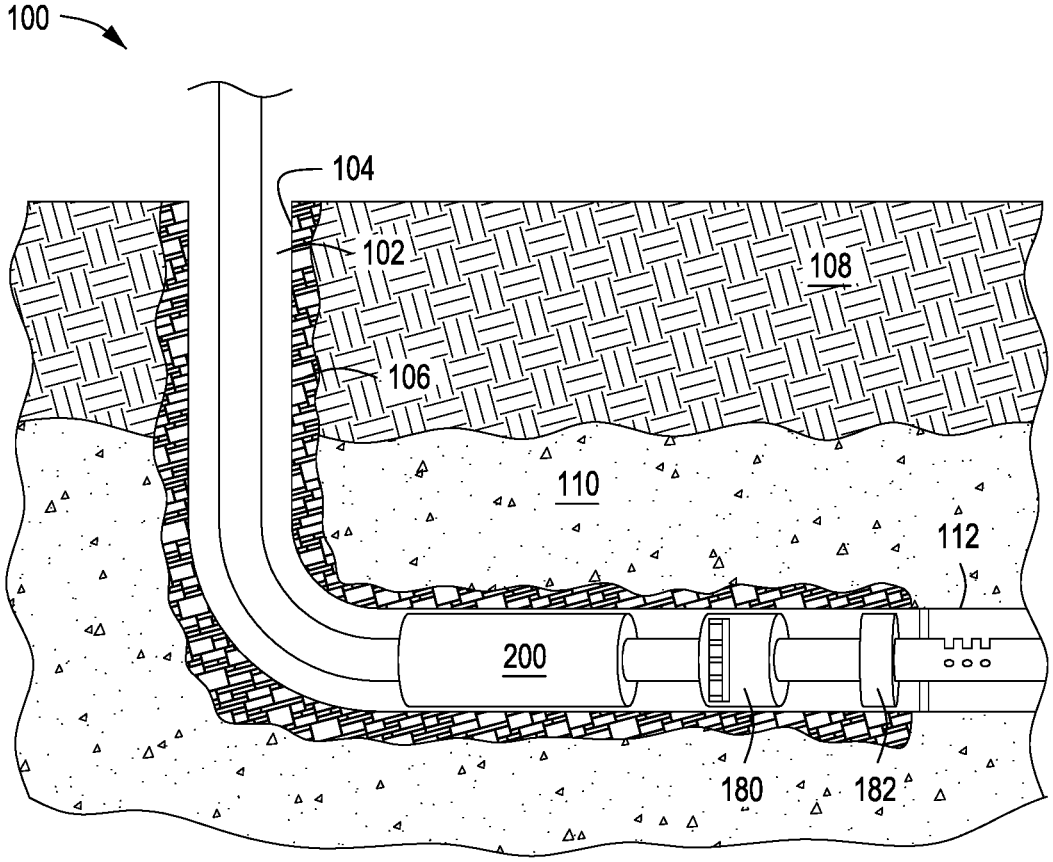
FIG. 1 depicts a schematic view an interventionless packer setting and testing system containing a hydraulic setting tool deployed downhole in a completion string, according to one or more embodiments.

FIG. 1 depicts a schematic view an interventionless packer setting and testing system 100 containing a hydraulic setting tool 200 deployed downhole in a wellbore 102 formed in a subterranean formation 110, according to one or more embodiments. The hydraulic setting tool 200 can be positioned in or near one or more completion strings 112 contained in the subterranean formation 110. The completion strings 112 are used to produce hydrocarbons, such as oil and/or natural gas, as well as other fluids, such as water or aqueous solutions, from the subterranean formation 110.

The wellbore 102 extends through the various earth strata 108 including the subterranean formation 110. The wellbore 102 is shown with a liner or casing 104 that can be secured by cement 106 disposed on the outer surface of the casing 104. It is not necessary for a liner or casing 104 to be cemented in a wellbore 102. Note that, in this specification, the terms "liner" and "casing" are used interchangeably to describe tubular materials, which are used to form protective linings in wellbores. Liners and casings may be made from one or more materials including, but not limited to, metals, plastics, or composites. The materials for the liners and casings may be expanded or unexpanded as part of an installation procedure and may be segmented or continuous.

One or more packers 180 and one or more liner hangers 182 may be located within the casing 104 to provide zonal isolation to the production of hydrocarbons in these zones. The packer 180 is actuated by the interventionless packer setting mechanism by the hydraulic setting tool 200. When set, the packer 180 isolates a zone of the annulus within the wellbore 102, separating the completion string 112 from the remaining upstream portion of the wellbore 102. The hydraulic setting tool 200 can be used to set the packer 180 and run a pressure test in during the same run or trip downhole.

Even though FIG. 1 depicts the wellbore 102 in horizontal and vertical positions and the completion string 112 in a horizontal position, it should be understood that the interventionless packer setting and testing system 100 and the hydraulic setting tool 200 are equally well-suited for use in wellbores and completion strings having horizontal, vertical, slanted, or multilateral positions. Also, even though FIG. 1 depicts an onshore or land-based operation, it should be appreciated that the interventionless packer setting and testing system 100 and the hydraulic setting tool 200 are equally well-suited for use in offshore operations.

Figure 2A:
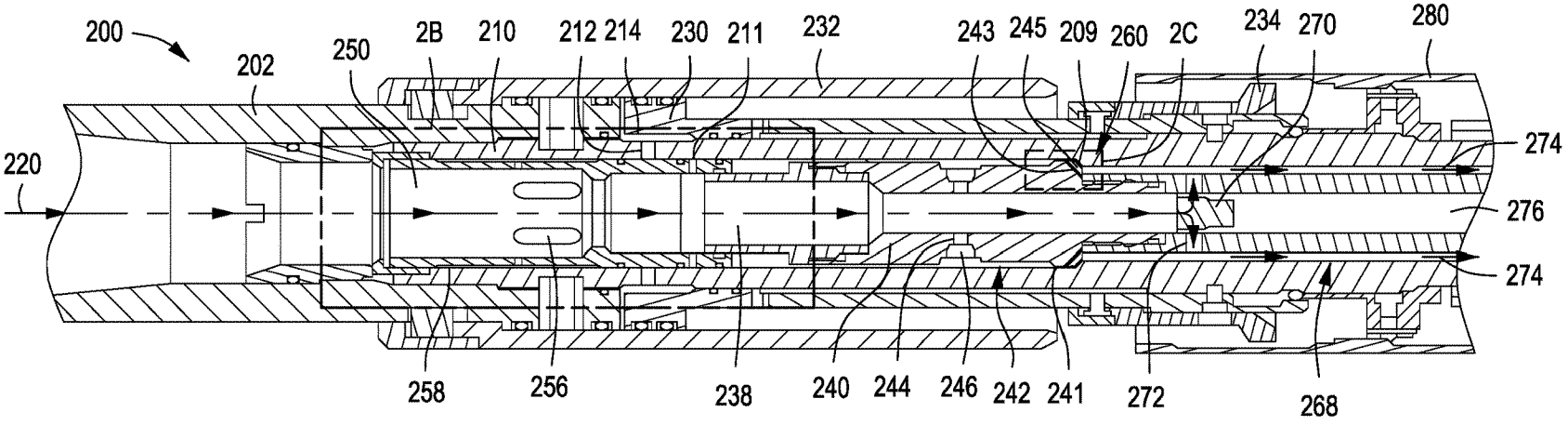
FIGS. 2A-2C depict schematic views of an isolation sleeve on the hydraulic setting tool in the closed position and a packer in an unset position, according to one or more embodiments.
Figure 2C:
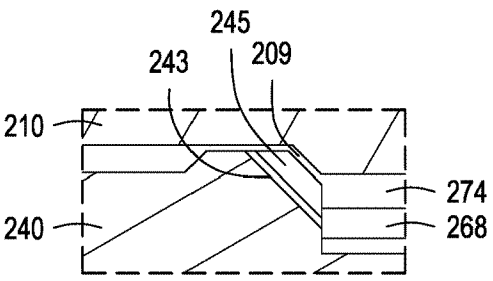
Figure 2B:
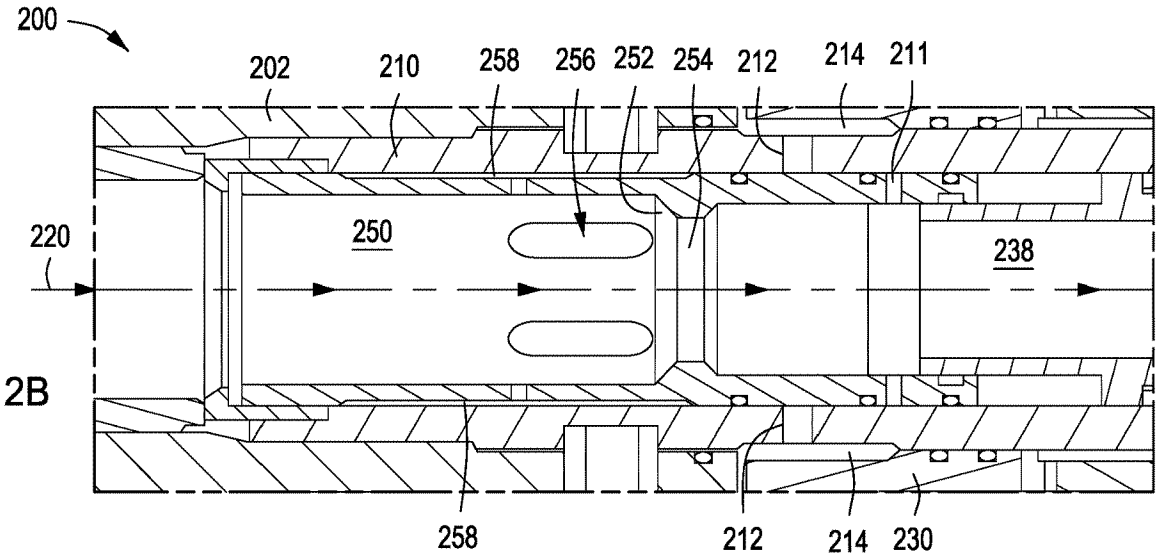

FIGS. 2A-2C depict schematic views of the hydraulic setting tool 200 prior to beginning to set a packer 280, according to one or more embodiments. The hydraulic setting tool 200 includes a body 202 coupled to a mandrel 210 that is at least partially within the body 202. The mandrel 210 contains an isolation sleeve 250, a support element 238, a nogo sub assembly 240, and a wash pipe assembly 268, each in fluid communication with the body 202. A main flow path 220 allows a fluid to pass through the hydraulic setting tool 200 and extends from the body 202, through the isolation sleeve 250, the support element 238, the nogo sub assembly 240, and the wash pipe assembly 268.

The hydraulic setting tool 200 also includes a piston housing 232 surrounding at least an outside portion or segment of the mandrel 210. A hydraulic piston 230 is disposed between the piston housing 232 and the segment of the mandrel 210. A piston cavity 214 is located or at least partially defined between the piston 230, the piston housing 232, and the portion of the mandrel 210. A port 212 passes through the mandrel 210 and provides fluid communication between the main flow path 220 and the piston cavity 214. The piston 230 is movable within the piston housing 232 by a pressure differential in the piston cavity 214 as communicated through the port 212. An engagement member 234 can be coupled to the piston 230 and configured to engage and set the packer 280 during operations. In one or more examples, the piston 230 is a hydraulic setting piston and can be used to set the piston 280.

The isolation sleeve 250 is movable along the main flow path 220 between a closed position and an opened position to control the fluid communication between the main flow path 220 and the piston cavity 214 via the port 212. Specifically, FIGS. 2A and 2B illustrate the isolation sleeve 250 on the hydraulic setting tool 200 in the closed position and the packer 280 in an unset position. In the closed position, the isolation sleeve 250 prevents the pressure within the wellbore (e.g., tubing pressure) from reaching and engaging the piston 230. The isolation sleeve 250 includes one or more fluid passages or first fluid outlets 254 and one or more second fluid outlets 256. The isolation sleeve 250 also includes one or more shoulders 252 at least partially encompassing the first fluid outlet 254. The first fluid outlet 254 can be used for passing the fluid along the main flow path 220 when the isolation sleeve 250 is in the closed position. The second fluid outlets 256 can be used for passing the fluid along one or more other flow paths when the isolation sleeve 250 is in the opened position, for example, a secondary flow path 222, shown in FIGS. 3A and 3B and further discussed below.

Figure 3A:
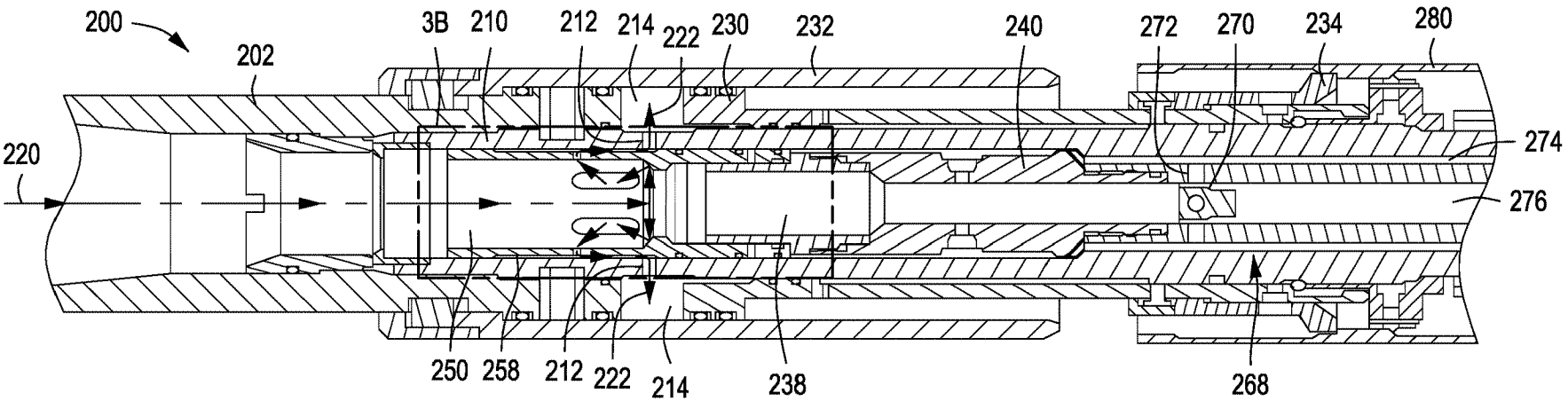
FIGS. 3A and 3B depict schematic views of the isolation sleeve on the hydraulic setting tool in the opened position and the packer in a position of starting to be set, according to one or more embodiments.
Figure 3B:
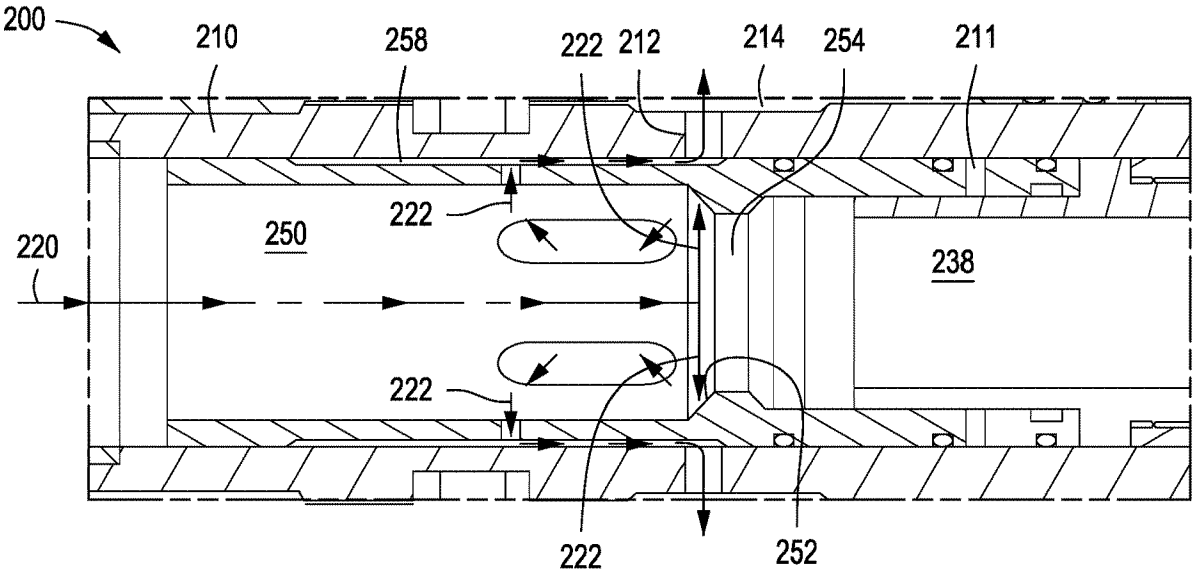

When the isolation sleeve 250 is in the closed position, a static fluid communication is maintained along the main flow path 220 by having a remotely activated valve 270, located downstream of the isolation sleeve 250, in an opened position, as depicted in FIGS. 2A and 2B. The remotely activated valve 270 controls the fluid passing through the first fluid outlet 254 of the isolation sleeve 250. If the remotely activated valve 270 is activated and placed into a closed position, the fluid flow along the main flow path 220 between the first fluid outlet 254 and the remotely activated valve 270 becomes stagnant and the isolation sleeve 250 moves to the opened position, as shown in FIGS. 3A and 3B and further discussed below.

The support element 238 and the nogo sub assembly 240 are located between and in fluid communication with the isolation sleeve 250 and the remotely activated valve 270 along the main flow path 220, as depicted in FIGS. 2A and 2C. The support element 238 and the nogo sub assembly 240 can be integral or each can be an independent, separate unit or piece. The nogo sub assembly 240 also contains a pressure release system 242 usable in a contingency operation to release pressure within the hydraulic setting tool 200. The pressure release system 242 includes a pressure release pathway 244 and a pressure activated safety valve 246 in fluid communication with one another. The pressure activated safety valve 246 can be or include, but is not limited to, one or more rupture disks, one or more safety valves, one or more relief valves, or any combination thereof. Once exiting from the pressure activated safety valve 246, the fluid flows away from the nogo sub assembly 240 through the pressure release pathway 244 toward one or more pathways 241. The pathway 241 can be coupled to and in fluid communication with any other channel or pathway downstream, such as the outer channel 274.

The pressure release system 242 can be located at, near, or upstream of an interface 260 between the nogo sub assembly 240 and the mandrel 210, as depicted in FIGS. 2A and 2C. The interface 260 includes a shoulder or surface 209 on the mandrel 210 facing the surface 243 on the nogo sub assembly 240. The pressure release system 242 also includes one or more flutes 245 located at the interface between the mandrel 210 and the nogo sub assembly 240 along the pathway 241 and/or the outer channel 274. The flutes 245 can be formed or positioned on the surface 209 on the mandrel 210 (not shown), the surface 243 on the nogo sub assembly 240 (FIG. 2C), or both surfaces 209, 243. The flutes 245 can be downstream of and in fluid communication with the pressure release pathway 244.

The hydraulic setting tool 200 includes one or more shear pins 211 that retain or otherwise couple the isolation sleeve 250 to one or more components or portions of the hydraulic setting tool 200 when the isolation sleeve 250 is in the closed position. For example, the component of the hydraulic setting tool 200 may be the mandrel 210, the support element 238, the nogo sub assembly 240, another components or surface within the hydraulic setting tool 200, and/or any combination thereof. In the depicted configuration, the support element 238 and the nogo sub assembly 240 are located between the isolation sleeve 250 and the remotely activated valve 270. Hydraulic pressure is applied to the isolation sleeve 250 via operating the remotely activated valve 270 in order to severe, shear, break, bend, or otherwise remove the shear pin 211. Once the shear pin 211 is absent, removed, sheared, or otherwise broken, then the isolation sleeve 250 is uncoupled from the component of the hydraulic setting tool 200 and is free to move into the opened position.

The wash pipe assembly 268 is coupled downstream of and in fluid communication with the nogo sub assembly 240 along the main flow path 220. The wash pipe assembly 268 can include the remotely activated valve 270, one or more ports 272, one or more outer channels 274, and an inner channel 276. The outer channel 274 is formed between the mandrel 210 and the wash pipe assembly 268 and the inner channel 276 extends axially through the wash pipe assembly 268. The remotely activated valve 270 can receive fluid from the nogo sub assembly 240 and control the flow therethrough. The remotely activated valve 270 also is operable to control the flow of the fluid through the outer channel 274 along the main flow path 220, as depicted in FIG. 2A. The remotely activated valve 270 is also operable to control the flow of the fluid through the inner channel 276 (not shown). In addition, the remotely activated valve 270 is operable to stop the flow of the fluid in the wash pipe assembly 268, that is, there is no fluid flowing through the outer channel 274 or the inner channel 276, as depicted in FIGS. 3A and 4.

Figure 4:
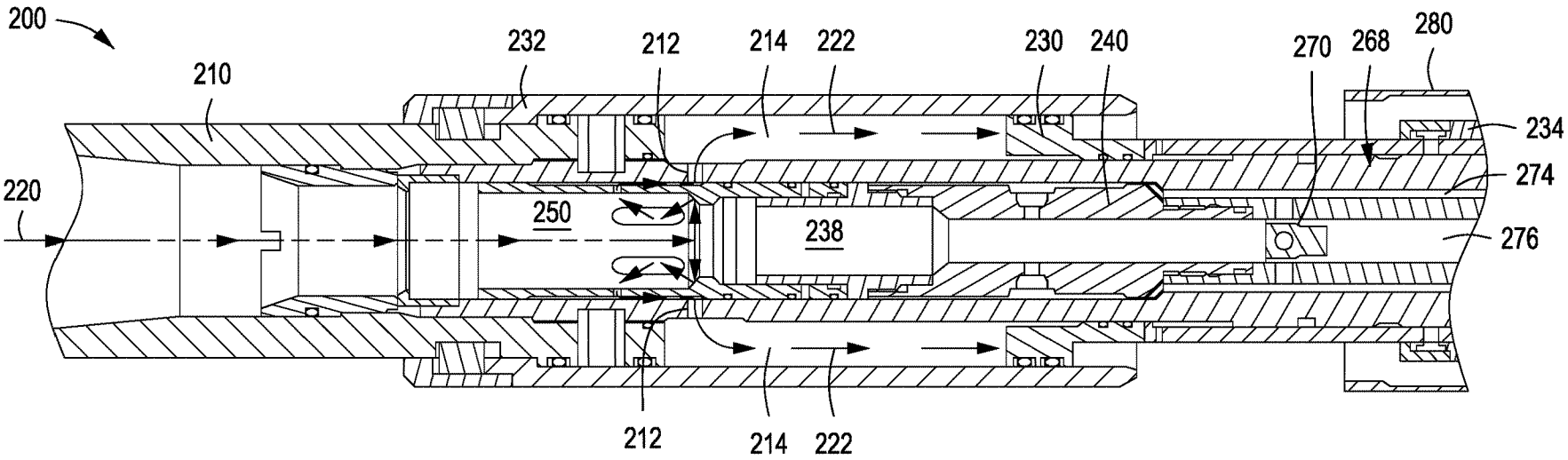
FIG. 4 depicts a schematic view of the isolation sleeve on the hydraulic setting tool in the opened position and the packer in a set position, according to one or more embodiments.

FIGS. 3A and 3B depict schematic views of the hydraulic setting tool 200 starting to set the packer 280 and FIG. 4 depicts a schematic view of the hydraulic setting tool 200 after setting the packer 280. Specifically, FIGS. 3A and 3B illustrate the isolation sleeve 250 on the hydraulic setting tool 200 in the closed position, the piston 230 and the engagement member 234 as moved toward the packer 280 for engaging and setting the packer 280 that is still shown in an unset position. FIG. 4 illustrates the isolation sleeve 250 on the hydraulic setting tool 200 in the closed position, the piston 230 and the engagement member 234 further moved toward and engaged with the packer 280 that is shown in a set position.

FIG. 3B depicts the secondary flow path 222 that extends from the main flow path 220 to the piston cavity 214 via the port 212. Once the remotely activated valve 270 is in the closed position, the fluid flow along the main flow path 220 upstream of the first fluid outlet 254 applies additional pressure to the shoulder 252 which pushes the isolation sleeve 250 into the opened position. The cavity 258 is located between the mandrel 210 and the isolation sleeve 250 and in fluid communication with the second fluid outlet 256. Therefore, when the isolation sleeve 250 is in the opened position, the fluid in the second fluid outlet 256 and the cavity 258 is stagnate. The fluid can now pass or flow through the second fluid outlets 256 along the secondary flow path 222 toward a cavity 258, the port 212, and the piston cavity 214. FIG. 3B depicts a sheared or portion of the shear pin 211, a bent shear pin 211, or a vacancy or hole that lacks the shear pin 211 is remaining after the shear pin 211 is removed, sheared, bent, or otherwise broken.

The remotely activated valve 270 may be manually actuated. In one or more embodiments, however, the remotely activated valve 270 may be a computer-controlled, electromechanical device that may be repeatedly opened and closed by remote command. For example, the remotely activated valve 270 may be the same as or similar to the electromechanical ball valve unit commercially available as the electronic remote equalizing device (eRED), known as the ERED® valve, manufactured by Red Spider Technology through Halliburton Energy Services, Inc. of Houston, Tex., USA. Also, the remotely activated valve 270 may be the same or similar to the valve described and discussed in U.S. Pub. No. 2016/0281461.

The remotely activated valve 270 may include a sensing system, a signal processor, and/or an actuation device arranged within a body. The inlet port to the remotely activated valve 270 may feed a pressure channel that extends axially through the remotely activated valve 270 and fluidly communicates with the sensing system. The sensing system may include one or more pressure sensors or transducers configured to detect, measure, and/or report fluid pressures within the remotely activated valve 270 as sensed through the pressure channel.

The sensing system may be communicably coupled to the signal processor, which may be configured to receive pressure signals generated by the sensing system. While not shown, the signal processor may include various computer hardware used to operate the remotely activated valve 270 including, but is not limited to, a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), or erasable programmable read only memory (EPROM)), registers, hard disks, removable disks, CD-ROMS, or any other like suitable storage device or medium.

The actuation device may be communicably coupled to the signal processor and configured to actuate the remotely activated valve 270 upon receiving a command signal generated by the signal processor. The actuation device may be operatively coupled to the remotely activated valve 270, such as via a drive shaft, a gearing mechanism, or the like. The actuation device may be any electrical, mechanical, electromechanical, hydraulic, or pneumatic actuation device that is able to rotate the remotely activated valve 270 about the central axis and thereby move the remotely activated valve 270 between the open and closed positions. In operation, for example, when a given command signal is received from the signal processor, the actuation device may be configured to rotate the remotely activated valve 270 about the central axis from the closed position to the open position.

The remotely activated valve 270 may be programmed to be responsive to pressure pulses sensed by the sensing system via the pressure channel. The sensing system may be configured to detect the pressure pulses and report the same to the signal processor, which compares the received pressure signals with one or more signature pressure pulses stored in memory. Once a signature pressure pulse is detected by the sensing system, the signal processor may be configured to generate and send a command signal to the actuation device to actuate the remotely activated valve 270 between open and closed positions. The signature pressure pulse that may trigger the remotely activated valve 270 may include one or more cycles of pressure pulses at a predetermined amplitude (e.g., strength or pressure) and/or over a predetermined amount of time (e.g., frequency). In other embodiments, the signature pressure pulse may be a series of pressure increases over a predetermined or defined time period followed by a reduction of the pressure for another predetermined or defined period. Several different types or configurations of potential signature pressure pulses may be used to trigger actuation of the remotely activated valve 270.

The remotely activated valve 270 may be or include an interventionless valve. The remotely activated valve 270 can be activated by one or more triggers. Exemplary triggers can be based on or include, but is not limited to, one or more temperatures, pressures, flow rates, times, changes thereof, or any combination thereof. In one or more embodiments, the trigger is based on at least one of the temperature of the fluid, the pressure of the fluid, the flow rate of the fluid, or any combination thereof.

Upon completion of the setting and testing operation, the remotely activated valve 270 may be placed back into the opened position by sending another triggering mechanism downhole. By opening the remotely activated valve 270, the isolation sleeve 250 moves back into the closed position as the hydraulic pressure on the shoulder 252 diminishes. Once the isolation sleeve 250 is in the closed position, the main flow path 220 is established, the secondary flow path 222 is ceased, and the hydraulic pressure in the piston cavity 214 is at least reduced or removed. Thus, the engagement member 234 disengages from the packer 280 and at this stage of the operation, the hydraulic setting tool 200 appears as in FIGS. 2A and 2B, but the packer 280 is set. The hydraulic setting tool 200 can now be recovered from the borehole.

In one or more embodiments, an interventionless packer setting and testing system includes the packer 280 and the hydraulic setting tool 200. The hydraulic setting tool 200 includes the main flow path 220, the secondary flow path 222, and the engagement member 234. The main flow path 220 is in fluid communication to and located between the isolation sleeve 250 and the remotely activated valve 270. The secondary flow path 222 is in fluid communication to and located between the isolation sleeve 250 and the piston 230. The engagement member 234 is coupled to the piston 230 and configured to set the packer 280. The isolation sleeve 250 is movable from the closed position to the opened position by closing the remotely activated valve 270. The secondary flow path 222 is closed when the isolation sleeve 250 is in the closed position and opened when the isolation sleeve 250 is in the opened position.

In some embodiments, a method for setting one or more packers in the wellbore includes positioning the hydraulic setting tool 200 and the packer 280 into the wellbore. The hydraulic setting tool 200 and the packer 280 can be positioned or otherwise located in a horizontal completion system or a multilateral completion system contained in the subterranean formation. The fluid is flowed along the main flow path 220 extending through the isolation sleeve 250 disposed in the hydraulic setting tool 200. The remotely activated valve 270 is located downstream from the isolation sleeve 250 along the main flow path 220. The remotely activated valve 270 can be at least partially closed or completely closed to reduce or cease the fluid from passing or flowing through the remotely activated valve 270 and to apply hydraulic pressure to the isolation sleeve 250.

One or more triggers can be activated to at least partially or completely close the remotely activated valve 270. The isolation sleeve 250 can move or change from a closed position to an opened position by the hydraulic pressure applied thereto. The secondary flow path 222 is closed when the isolation sleeve 250 is in the closed position and the secondary flow path 222 is opened when the isolation sleeve 250 is in the opened position. At least a portion of the fluid is diverted from the main flow path 220, along the secondary flow path 222, and to the piston 230. The fluid contacts and moves the piston 230 that in turn drives or otherwise moves the engagement member 234 to set the packer 280.

The method can also include severing, shearing, breaking, bending, or otherwise removing the shear pin 211 by applying the hydraulic pressure to the isolation sleeve 250. In one or more embodiments, prior to at least partially closing the remotely activated valve 270, the method includes pressurizing the fluid in the wellbore to a test pressure without setting the packer 280. The test pressure is equal to or greater than the hydraulic pressure applied to the isolation sleeve 250.

In one or more embodiments, the hydraulic setting tools and methods described and discussed herein provide for: conveying a packer and seal assembly down hole; stringing into a seal bore with the seal assembly; testing the tubing, the running tool, the packer, the seals, and the lower completion above the packer; setting pressure but without setting the packer; actuating a downhole barrier without intervention; and subsequently setting the packer, then opening the barrier without intervention; and allowing the string to be tested again and the packer running tool to be retrieved in one run.

The interventionless packer setting and testing systems, hydraulic setting tools, and methods described and discussed herein can be used in single completions and multilateral (MLT) completions or junctions. The multilateral completions or junctions can have a Technology Advancement of MultiLaterals (TAML) rating of any one of levels 1-6. In one or more examples, the interventionless packer setting and testing systems, hydraulic setting tools, and/or methods can be used in multilateral completions or junctions that have a TAML rating of level 5, where an intermediate packer is run with seals below the deflector and junction. The method can provide testing the packer, seals, and the motherbore junction without setting the packer, and subsequently after the testing, the packer can be hydraulically set without intervention (e.g., inclusive of ball drop). In some embodiments, the hydraulic setting tools is isolated from hydraulic pressure for testing or circulating operations that can then be activated using a remotely activated valve (e.g., electronic remote equalizing device (eRED), known as the ERED® valve) to disable the isolation mechanism.

The isolation sleeve in the closed position prevents tubing pressure within the wellbore from reaching and engaging the piston. Therefore, the operator to use the packer with lower seals and have communication through the workstring, hydraulic running tool, packer, tailpipe and seals. Furthermore, the operator can string into a lower seal bore and test the workstring, hydraulic running tool, packer, tailpipe, seals and components of the lower completion in the motherbore without setting the packer, even against a closed barrier or cased hole.

In order to set the packer, the operator can choose from various triggers based on temperature, pressure and time setup in a logic pathway that will trigger the remotely activated valve to close. After the remotely activated valve closes, applying tubing pressure again shifts open the isolation sleeve, exposing the hydraulic piston in the hydraulic setting tool. The pressure drives the piston and sets the packer. Pressure may be applied as many times as desired to set the packer and/or test the work string and/or seals. When setting and testing is complete, the temperature, pressure, and/or time logic pathway or other trigger is executed and the remotely activated valve is triggered to open, allowing the hydraulic setting tool to be recovered from the borehole.

In some examples, the seals can be integrated into the hydraulic setting tool as an inner string, hung below the HPT tool. The remotely activated valve can be locked in place using a three-way sub on the bottom of the HPT tool using a three-way sub and a ported lock nut. In this configuration, the fluid from the injection and pressure test is allowed to flow down through the HPT tool, through the three-way sub, ported lock nut, down the wash pipe, and out the lower seal assembly.

In addition to the embodiments described above, embodiments of the present disclosure further relate to one or more of the following paragraphs:

1. A hydraulic setting tool, comprising: a mandrel comprising a main flow path; a piston housing surrounding at least a portion of the mandrel; a piston disposed between the piston housing and the portion of the mandrel, wherein the piston, the piston housing, and the portion of the mandrel define a cavity disposed therebetween; a port passing through the mandrel and configured to provide fluid communication between the main flow path and the cavity; an isolation sleeve located within the mandrel and movable along the main flow path between a closed position and an opened position to control the fluid communication between the main flow path and the cavity via the port; and a remotely activated valve located downstream from the isolation sleeve along the main flow path, wherein the remotely activated valve controls the fluid passing therethrough.

2. A packer setting system, comprising: a packer; and a hydraulic setting tool configured to set the packer in a wellbore, the hydraulic setting tool comprising: a main flow path in fluid communication to and located between an isolation sleeve and a remotely activated valve; a secondary flow path in fluid communication to and located between the isolation sleeve and a piston; an engagement member coupled to the piston and configured to set the packer; wherein the isolation sleeve is movable from a closed position to an opened position by closing the remotely activated valve; and wherein the secondary flow path is closed when the isolation sleeve is in the closed position and opened when the isolation sleeve is in the opened position.

3. A packer setting system, comprising: a packer; and a hydraulic setting tool configured to set the packer in a wellbore, the hydraulic setting tool comprising: a mandrel comprising a main flow path for passing a fluid therethrough; a piston disposed between a piston housing and the mandrel; an engagement member coupled to the piston and configured to set the packer; a cavity located between the piston, the piston housing, and the mandrel; a port passing through the mandrel to provide fluid communication between the main flow path and the cavity; an isolation sleeve located within the mandrel and movable between a closed position and an opened position for controlling the fluid communication between the main flow path and the cavity via the port; and a remotely activated valve located downstream from the isolation sleeve, wherein the remotely activated valve controls the fluid passing therethrough.

4. A method for setting a packer in a wellbore, comprising: positioning a hydraulic setting tool and the packer into the wellbore; passing a fluid along a main flow path extending through an isolation sleeve disposed in the hydraulic setting tool; at least partially closing a remotely activated valve located downstream from the isolation sleeve along the main flow path to reduce or cease the fluid from passing through the remotely activated valve and to apply a hydraulic pressure to the isolation sleeve; moving the isolation sleeve from a closed position to an opened position by the hydraulic pressure applied thereto, wherein a secondary flow path is closed when the isolation sleeve is in the closed position and opened when the isolation sleeve is in the opened position; diverting at least a portion of the fluid from the main flow path, along the secondary flow path, and to a piston; and driving an engagement member by the piston to set the packer.

5. The method of paragraph 4, further comprising activating a trigger to at least partially close the remotely activated valve, wherein the trigger is based on at least one of temperature of the fluid, pressure of the fluid, flow rate of the fluid, time, or any combination thereof.

6. The method of paragraph 4 or 5, further comprising applying the hydraulic pressure to the isolation sleeve to severe a shear pin and move the isolation sleeve.

7. The method according to any one of paragraphs 4-6, prior to at least partially closing the remotely activated valve, the method further comprises pressurizing the fluid in the wellbore to a test pressure without setting the packer, wherein the test pressure is equal to or greater than the hydraulic pressure applied to the isolation sleeve.

8. The hydraulic setting tool, the packer setting system, and/or the method according to any one of paragraphs 1-7, wherein the piston is movable within the piston housing by a pressure differential in the cavity.

9. The hydraulic setting tool, the packer setting system, and/or the method according to any one of paragraphs 1-8, wherein the isolation sleeve comprises a first fluid outlet for passing a fluid along the main flow path when the isolation sleeve is in the closed position.

10. The hydraulic setting tool, the packer setting system, and/or the method according to paragraph 9, further comprising a secondary flow path extending from the main flow path to the cavity via the port.

11. The hydraulic setting tool, the packer setting system, and/or the method according to paragraph 10, wherein the isolation sleeve further comprises a second fluid outlet for passing the fluid along the secondary flow path when the isolation sleeve is in the opened position.

12. The hydraulic setting tool, the packer setting system, and/or the method according to paragraph 9, wherein the isolation sleeve further comprises a shoulder at least partially encompassing the first fluid outlet.

13. The hydraulic setting tool, the packer setting system, and/or the method according to any one of paragraphs 1-12, further comprising a shear pin that couples the isolation sleeve to a component of the tool when the isolation sleeve is in the closed position.

14. The hydraulic setting tool, the packer setting system, and/or the method according to paragraph 13, wherein the component of the tool is at least one of the mandrel, a support element, or a nogo sub assembly.

15. The hydraulic setting tool, the packer setting system, and/or the method according to paragraph 13, wherein the isolation sleeve is uncoupled from the component of the tool when the shear pin is absent or sheared and when the isolation sleeve is in the opened position.

16. The hydraulic setting tool, the packer setting system, and/or the method according to any one of paragraphs 1-15, further comprising at least one of a support element, a nogo sub assembly, or a combination thereof located between and in fluid communication with the isolation sleeve and the remotely activated valve.

17. The hydraulic setting tool, the packer setting system, and/or the method according to paragraph 16, wherein the nogo sub assembly comprises a pressure release system comprising a pressure activated safety valve in fluid communication with a pressure release pathway.

18. The hydraulic setting tool, the packer setting system, and/or the method according to paragraph 17, wherein the pressure activated safety valve comprises at least one of rupture disk, a safety valve, a relief valve, or any combination thereof.

19. The hydraulic setting tool, the packer setting system, and/or the method according to paragraph 17, wherein the pressure release system comprises flutes in fluid communication with the pressure release pathway and located at an interface between the nogo sub assembly and the mandrel.

20. The hydraulic setting tool, the packer setting system, and/or the method according to any one of paragraphs 1-19, wherein the remotely activated valve is activated by a trigger based on temperature, pressure, flow rate, time, or combinations thereof.

21. The hydraulic setting tool, the packer setting system, and/or the method according to any one of paragraphs 1-20, wherein the piston comprises a hydraulic setting piston.

22. The hydraulic setting tool, the packer setting system, and/or the method according to any one of paragraphs 1-21, wherein the remotely activated valve in an opened position is configured to pressurize a fluid in the wellbore to a test pressure without setting the packer, and wherein the test pressure is equal to or greater than a hydraulic pressure applied for moving the isolation sleeve.

23. The hydraulic setting tool, the packer setting system, and/or the method according to any one of paragraphs 1-22, wherein the hydraulic setting tool and the packer are located in a horizontal completion system contained in the wellbore.

24. The hydraulic setting tool, the packer setting system, and/or the method according to any one of paragraphs 1-23, wherein the piston is exposed to the fluid passing through a port and into a cavity via the secondary flow path when the isolation sleeve is in the opened position.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

What is claimed is:

1. A hydraulic setting tool for setting a packer, comprising:

a mandrel comprising a main flow path;

a piston housing surrounding at least a portion of the mandrel;

a piston disposed between the piston housing and the portion of the mandrel, wherein the piston, the piston housing, and the portion of the mandrel define a cavity disposed therebetween;

a port passing through the mandrel and configured to provide fluid communication between the main flow path and the cavity;

an isolation sleeve located within the mandrel and movable along the main flow path between a closed position and an opened position to control the fluid communication between the main flow path and the cavity via the port, wherein the hydraulic setting tool is configured to set the packer when the isolation sleeve shifted to the open position; and a remotely activated valve located downstream from the isolation sleeve within the main flow path, the remotely activated valve adjustable, between an open position and a closed position and activated by a trigger based on temperature, pressure, flow rate, time, or combinations thereof, and the remotely activated valve actuable to reduce or cease flow through the remotely activated valve to increase pressure within the main flow path uphole of the remotely activated valve to shift the isolation sleeve from the closed position to the opened position.

2. The tool of claim 1, wherein the piston is movable within the piston housing by a pressure differential in the cavity.

3. The tool of claim 1, wherein the isolation sleeve comprises a first fluid outlet for passing a fluid along the main flow path when the isolation sleeve is in the closed position.

4. The tool of claim 3, further comprising a secondary flow path extending from the main flow path to the cavity via the port.

5. The tool of claim 4, wherein the isolation sleeve further comprises a second fluid outlet for passing the fluid along the secondary flow path when the isolation sleeve is in the opened position.

6. The tool of claim 3, wherein the isolation sleeve further comprises a shoulder at least partially encompassing the first fluid outlet.

7. The tool of claim 1, further comprising a shear pin that couples the isolation sleeve to a component of the tool when the isolation sleeve is in the closed position.

8. The tool of claim 7, wherein the component of the tool is at least one of the mandrel, a support element, or a nogo sub assembly.

9. The tool of claim 7, wherein the isolation sleeve is uncoupled from the component of the tool when the shear pin is absent or sheared and when the isolation sleeve is in the opened position.

10. The tool of claim 1, further comprising at least one of a support element, a nogo sub assembly, or a combination thereof located between and in fluid communication with the isolation sleeve and the remotely activated valve.

11. The tool of claim 10, wherein the nogo sub assembly comprises a pressure release system comprising a pressure activated safety valve in fluid communication with a pressure release pathway.

12. The tool of claim 11, wherein the pressure activated safety valve comprises at least one of rupture disk, a safety valve, a relief valve, or any combination thereof.

13. The tool of claim 11, wherein the pressure release system comprises flutes in fluid communication with the pressure release pathway and located at an interface between the nogo sub assembly and the mandrel.

14. A packer setting system, comprising:

a packer; and a hydraulic setting tool comprising:

a mandrel comprising a main flow path;

a piston housing surrounding at least a portion of the mandrel;

a piston disposed between the piston housing and the portion of the mandrel, wherein the piston, the piston housing, and the portion of the mandrel define a cavity disposed therebetween;

a port passing through the mandrel and configured to provide fluid communication between the main flow path and the cavity;

an isolation sleeve located within the mandrel and movable along the main flow path between a closed position and an opened position to control the fluid communication between the main flow path and the cavity via the port, wherein the hydraulic setting tool sets the packer when the isolation sleeve shifted to the open position; and a remotely activated valve located downstream from the isolation sleeve along the main flow path, the remotely activated valve adjustable between an open position and a closed position and activated by a trigger based on temperature, pressure, flow rate, time, or combinations thereof, and the remotely activated valve actuable to reduce or cease flow through the remotely activated valve to increase pressure within the main flow path uphole of the remotely activated valve to shift the isolation sleeve from the closed position to the opened position.

15. A packer setting system, comprising:

a packer; and a hydraulic setting tool configured to set the packer in a wellbore, the hydraulic setting tool comprising:

a main flow path in fluid communication to and located between an isolation sleeve and a remotely activated valve adjustable between an open position and a closed position and activated by a trigger based on temperature, pressure, flow rate, time, or combinations thereof, and the remotely activated valve actuable to reduce or cease flow through the remotely activated valve to increase pressure within the main flow path uphole of the remotely activated valve to shift the isolation sleeve from a closed position to an opened position;

a secondary flow path in fluid communication to and located between the isolation sleeve and a piston;

an engagement member coupled to the piston and configured to set the packer;

wherein the isolation sleeve is movable from a closed position to an opened position by closing the remotely activated valve;

wherein the secondary flow path is closed when the isolation sleeve is in the closed position and opened when the isolation sleeve is in the opened position; and wherein the hydraulic setting tool sets the packer when the isolation sleeve shifted to the open position.

16. The packer setting system of claim 15, wherein the remotely activated valve in the opened position is configured to pressurize a fluid in the wellbore to a test pressure without setting the packer, and wherein the test pressure is equal to or greater than a hydraulic pressure applied for moving the isolation sleeve.

17. A method for setting a packer in a wellbore, comprising:

positioning a hydraulic setting tool and the packer into the wellbore;

passing a fluid along a main flow path extending through an isolation sleeve disposed in the hydraulic setting tool;

activating a trigger to at least partially close a remotely activated valve adjustable between an open position and a closed position and located downstream from the isolation sleeve along the main flow path, wherein the trigger is based on at least one of temperature of the fluid, pressure of the fluid, flow rate of the fluid, time, or any combination thereof;

at least partially closing the remotely activated valve to reduce or cease the fluid from passing through the remotely activated valve and to apply a hydraulic pressure to the isolation sleeve;

moving the isolation sleeve from a closed position to an opened position by the hydraulic pressure applied thereto, wherein a secondary flow path is closed when the isolation sleeve is in the closed position and opened when the isolation sleeve is in the opened position;

diverting at least a portion of the fluid from the main flow path, along the secondary flow path, and to a piston; and driving an engagement member by the piston to set the packer.

18. The method of claim 17, further comprising applying the hydraulic pressure to the isolation sleeve to sever a shear pin and move the isolation sleeve.

19. The method of claim 17, prior to at least partially closing the remotely activated valve, the method further comprises pressurizing the fluid in the wellbore to a test pressure without setting the packer, wherein the test pressure is equal to or greater than the hydraulic pressure applied to the isolation sleeve.

* * * * *